US006168132B1

(12) United States Patent
Frank et al.

(10) Patent No.: US 6,168,132 B1
(45) Date of Patent: Jan. 2, 2001

(54) INJECTION VALVE WITH CONTROL VALVE

(75) Inventors: Wilhelm Frank, Bamberg; Günter Lewentz, Regensburg; Jürgen Rink, Wackersdorf; Gerd Schmutzler, Kareth; Joachim Vendulet, Köfering, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/379,219

(22) Filed: Aug. 23, 1999

Related U.S. Application Data

(63) Continuation of application No. PCT/DE98/03746, filed on Dec. 18, 1998.

(30) Foreign Application Priority Data

Dec. 23, 1997 (DE) ..... 197 57 656

(51) Int. Cl.[7] ..... F02M 47/02

(52) U.S. Cl. ..... 251/33; 251/30.01; 123/467; 123/496; 239/96; 239/124; 239/533.7; 239/533.9

(58) Field of Search ..... 257/30.01, 30.02, 257/33; 123/467, 496; 239/96, 124, 533.7, 533.9

(56) References Cited

U.S. PATENT DOCUMENTS 4,544,128 * 10/1985 Kolchinsky et al. ..... 251/30.01
4,674,688 * 6/1987 Kanesaka ..... 239/96 X
4,993,637 * 2/1991 Kanesaka ..... 239/96
5,271,599 * 12/1993 Kolchinsky et al. ..... 251/30.01 X
5,526,791 * 6/1996 Timmer et al. ..... 123/467
5,538,187 * 7/1996 Mueller et al. ..... 239/533.9 X
5,664,545 * 9/1997 Kato et al. ..... 123/496
5,779,149 * 7/1998 Hayes, Jr. ..... 239/533.9 X
5,875,764 * 3/1999 Kappel et al. ..... 123/467

FOREIGN PATENT DOCUMENTS

19624001A1 12/1997 (DE) .
0331198A2 9/1989 (EP) .
0604915A1 7/1994 (EP) .
0816670A1 1/1998 (EP) .
0826876A1 3/1998 (EP) .

* cited by examiner

*Primary Examiner*—Kevin Shaver
*Assistant Examiner*—John Bastianelli
(74) *Attorney, Agent, or Firm*—Herbert L. Lerner; Laurence A. Greenberg; Werner H. Stemer

(57) ABSTRACT

The injection valve has a control valve with a control chamber in which a closing member is disposed. The closing member is pressed against a corresponding sealing seat by a pressure (e.g. fuel pressure) in the control chamber. The closing member merges into a rod that passes through a drain hole and is connected to a spring plate. The spring plate is preloaded against the housing by a compression spring in such a way that the closing member is pressed against an associated sealing seat. The closing member can be raised from the sealing seat by an actuator piston which rests against the spring plate.

5 Claims, 2 Drawing Sheets

INJECTION VALVE WITH CONTROL VALVE

CROSS-REFERENCE TO RELATED APPLICATION

This is a continuation of copending International Application PCT/DE98/03746, filed Dec. 18, 1998, which designated the United States.

BACKGROUND OF THE INVENTION

Field of the Invention

The invention lies in the mechanical arts. Specifically, the invention relates to a valve operated with a control valve and, more particularly, to an injection valve with a control valve. The injection valve has a housing formed with a control chamber and a control piston which bounds the control chamber and is displaceable within the housing. A feed supplies the control chamber with pressure medium, in particular fuel, and the pressure medium flows out of the control chamber via a drain. A closing member is associated with a sealing seat of the drain and opens or closes the drain. A control device is arranged outside the control chamber and is operatively connected with the closing member. The sealing seat is formed on the high-pressure side and the closing member is disposed on the high-pressure side. The closing member is connected to a valve rod, which is passed through the drain, and which is operatively connected with the control device. The closing member is disposed in the control chamber, and the closing member is preloaded against the sealing seat with a spring means arranged outside the control chamber.

Injection valves with a control valve are used, for example, in a common rail injection system in order to control the pressure in a control chamber. The pressure in the control chamber acts via a control piston on an injection needle which rises from a valve seat as a function of the pressure, with the result that fuel is injected into an internal combustion engine.

U.S. Pat. No. 5,381,999 to Ricco (EP 0 604 915 A1) discloses an injection valve with a control valve in which a control chamber is connected via a restrictor to a drain controlled by a control valve. The control valve has a closing member which is associated with a valve seat formed at the end of the restrictor. The closing member is pressed onto the valve seat from the low-pressure side by spring elements. An electromagnet is provided to raise the closing member from the associated valve seat, thereby starting an injection process. However, that prior art injection valve is subject to the disadvantage that the restrictor is opened if the spring elements break.

European published patent application EP 0 826 876 A1, which is the most closely related prior art, describes an injection valve with a control valve which has a closing member that is associated with a valve seat and is connected to a piston which in operative connection with an actuator. The piston is partially enclosed by an annular spring holder with which a spring element is in operative connection in such a way that the closing member is pressed onto the valve seat from the low-pressure side via the piston. The closing member and the valve seat are mounted on the high-pressure side.

SUMMARY OF THE INVENTION

It is accordingly an object of the invention to provide an injection valve with a control valve, which overcomes the above-mentioned disadvantages of the heretofore-known devices and methods of this general type and which reliably closes the drain restrictor of the control chamber.

With the foregoing and other objects in view there is provided, in accordance with the invention, an injection valve, comprising:

a housing formed with a control chamber;

a control piston bounding the control chamber and being displaceably disposed in the housing;

a feed conduit communicating with the control chamber for supplying the control chamber with a pressure medium;

a drain communicating with the control chamber for draining pressure medium out of the control chamber, the drain being formed with a sealing seat on a high-pressure side;

a closing member disposed in the control chamber on the high-pressure side and being operatively associated with the sealing seat of the drain for selectively opening and closing the drain;

a control device outside the control chamber and operatively connected with the closing member;

a valve rod connected to the closing member, passing through the drain, and being operatively connected with the control device;

a spring holder connected to the valve rod on the low-pressure side, the spring holder being formed as a sleeve with a hollow space and a bottom plate at one end thereof, the bottom plate being connected to the valve rod and being associated with the drain;

a spring member clamped outside the control chamber between the spring holder and the housing for preloading the closing member against the sealing seat; and an actuator piston operatively connected with the control device and inserted into the hollow space of the sleeve.

It is a primary advantage of the invention that the closing member of the control valve is arranged on the high-pressure side and is pressed against the valve seat by the pressure in the control chamber. A further advantage resides in the fact that the closing member reliably closes the drain even if the preloading system are damaged.

In accordance with an added feature of the invention, the bottom plate is formed with an opening, the valve rod passes into the opening, and the valve rod is connected to the bottom plate in an upper region of the bottom plate.

In accordance with an additional feature of the invention, the drain is formed as a flow restrictor.

In accordance with another feature of the invention, there is provided a plate formed with an opening defining the drain, formed with a second recess adapted to partially accommodate the spring holder, and formed with a first recess at least partially forming the control chamber and defining the sealing seat.

In accordance with a further feature of the invention, a shape of the closing member is matched to a shape of the control chamber for minimizing a control volume of the control chamber.

In accordance with a concomitant feature of the invention, there is provided a control-valve unit that comprises the following elements:

a plate having the drain formed therein;

the closing member and the valve rod extending through the drain;

the spring holder with the valve rod connected thereto;

the spring element clamped between the spring holder and the plate and preloading the closing member against the sealing seat, wherein a spacing distance between the closing member and the spring holder is fixed at a predetermined value for setting a maximum stroke of the closing member.

It is a further advantage of the invention that the closing member is connected by a small diameter valve tappet to an actuator piston which has a larger diameter. The valve tappet is passed through a drain conduit which has a correspondingly small diameter. Owing to its large diameter, the actuator piston has a high rigidity, allowing the closing member to be moved precisely and rapidly by an actuator which controls the actuator piston. Since the drain hole has a small diameter, the closing member can also be of correspondingly small design, so that only a small force is necessary to move the closing member against the pressure in the control chamber and to thereby open or close the drain hole.

Other features which are considered as characteristic for the invention are set forth in the appended claims.

Although the invention is illustrated and described herein as embodied in an injection valve with control valve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
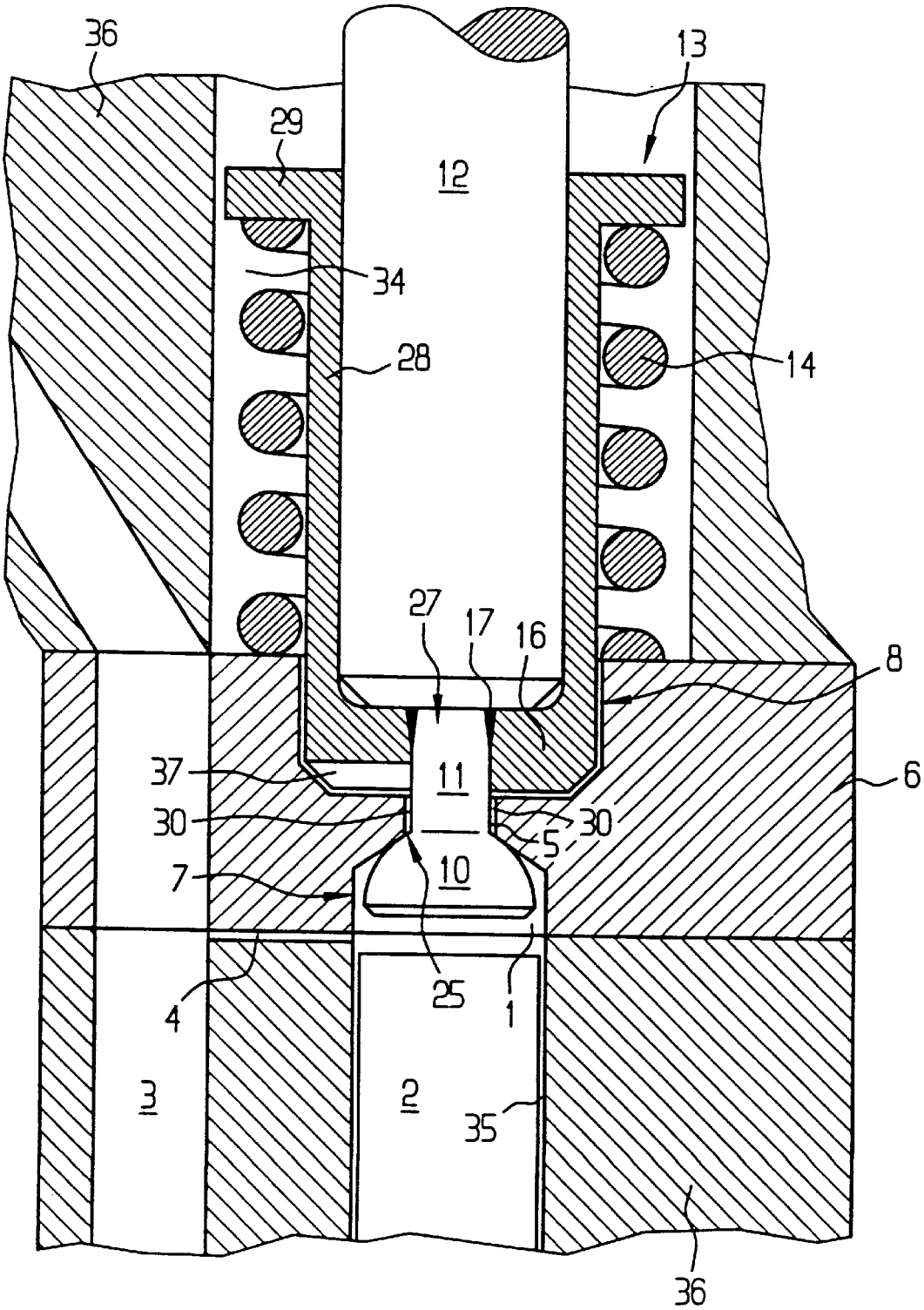
FIG. 1 is a partial sectional view of a first embodiment of the control valve according to the invention.

Referring now to the figures of the drawing in detail and first, particularly, to FIG. 1 thereof, there is seen a part of an injection valve in which a control valve is arranged. For the sake of simplicity, only the control valve, not the entire injection valve, is shown. The operation and construction of a corresponding injection valve are described, for example, in the above-mentioned U.S. Pat. No. 5,381,999 (EP 0 604 915 A1).

The control valve has a control chamber 1, which is connected to a fuel feed 3 via a feed restrictor 4. The control chamber 1 is bounded by a control piston 2. The control piston 2 is movable disposed in a piston bore 35 and is connected to the injection needle.

The control chamber 1 has a drain hole 5 which leads to a second recess 8 connected to the fuel tank by a drain line. At the top, the second recess 8 merges into a wider guide hole 34. Arranged in the control chamber 1 is a first closing member 10, which merges into a valve rod 11 that passes through the drain hole 5 into the second recess 8.

A spring plate or spring cup 13 is inserted into the second recess 8 which extends into the guide hole 35. The spring plate 13 has a U-shape which ends with a bottom plate 16. The bottom plate 16 is associated with the drain hole 5. The valve rod 11 is guided in the second recess 8 by a central hole 27 in the bottom plate 16. The valve rod 11 preferably ends flush with the upper side of the bottom plate 16 and is preferably connected to the bottom plate 16 in this area by a weld 17.

At the top, the bottom plate 16 merges into a sleeve 28 which, in the upper end region, has a stop ring 29 which is bent outwards. The second recess 8 and the first recess 7, which forms part of the control chamber 1, are preferably formed in a valve plate 6. The valve plate 6 is connected non positively (not form locking) to the housing 36 of the injection valve. A spring element, preferably a compression spring 14, is inserted under preload between the valve plate 6 and the stop ring 29, with the result that, in the rest position, the first closing member 10 is pressed upwards towards the drain hole 5 against an associated first sealing seat 25. Other spring means, such as a Belleville spring or a cup spring, can also be used instead of the compression spring.

The first sealing seat 25 is formed as part of the wall surface of the control chamber, in the region of the inlet to the drain hole 5. The drain hole 5 preferably represents a drain restrictor. In a development of the invention, the drain restrictor can also be formed downstream of the drain hole. In the rest position, the drain hole 5 is closed by the first closing member 10 owing to the compression spring 14. In addition, this exemplary embodiment has the advantage that, if the compression spring 14, the spring plate 13 or the valve rod 11 fail, the first closing member 10 is pressed against the first sealing seat 25 by the pressure prevailing in the control chamber 1 and the first closing member 10 thus closes the first sealing seat 25 in a self-locking manner.

The bottom plate 16, the sleeve 28 and the stop ring 29 form the spring plate 13, into the cylindrical cavity of which is inserted an actuator piston 12, the end of which rests against the bottom plate 16. The actuator piston 12 is arranged in such a way as to be movable in the spring plate 13 and is in operative connection with an actuator, e.g. a piezo-electric actuator, which moves the actuator piston.

The first sealing seat 25, in the preferred embodiment, is a conical seat. The first closing member 10 is preferably designed as a partial sphere, the partially spherical shape being associated with the first sealing seat 25. The partially spherical shape merges into the cylindrical shape of the valve rod 11 centrally at the apex. The partially spherical lateral surface of the first closing member 10 matches the shape of the first sealing seat 25.

The flow rate through the drain hole 5 is determined by the annular drain passage 30 formed by the drain hole 5 and the rod 11. The drain passage 30 is preferably designed in such a way that the drain passage 30 acts as a drain restrictor.

In a common rail injection system for a diesel internal combustion engine, pressures of up to 1800 bar are reached in the control chamber 1. To ensure that the drain restrictor 5 can be opened and closed with a closing member 10 at these pressures, the cross section of the drain restrictor 5 must be kept small so that the pressure surface of the first closing member 10 on which the high pressures act is also small. In the case of a small pressure surface, the actuator can provide the force required to open and close the first closing member 10 and can move the first closing member 10 with sufficient rapidity.

However, the small diameter of the drain hole 5 brings with it the disadvantage that the valve rod, which is passed through the drain hole, has an even smaller diameter. Due to its small diameter, the valve rod 10 is not very rigid. This is disadvantageous for rapid and precise control of the first closing member 10.

To ensure that the first closing member 10 closes rapidly and that the first sealing seat 25 is well sealed by the first closing member 10, it is furthermore advantageous to use a compression spring 14 with a high preload. However, this is only possible if the valve rod 11 is not very flexible.

It is therefore advantageous to make the drain restrictor 5 as short as possible to enable the valve rod 11 to be made as short as possible. The shorter the valve rod 11, the less flexible it is and the more rigid is the overall drive formed by the valve rod 11 and the actuator piston 12. The actuator piston 12 is located outside the control chamber, in a second recess 8 connected to a guide hole 35. This enables the actuator piston 12 to be of larger-diameter design, with the result that the actuator piston 12 is less flexible than the valve rod 11. Since the actuator piston is more rigid than the valve rod 11, the length of the actuator piston 12 is of little significance for the selection of the elastic properties.

A further optimization of the control valve is achieved by virtue of the fact that the first closing member 10 is matched to the shape of the control chamber 1 in such a way that the control volume in the control chamber 1 which is not occupied by the first closing member 10 is as small as possible. This allows rapid emptying and filling of the control chamber, thereby minimizing the operating times, during which pressure is built up or reduced in the control chamber. This minimizes the operating times during which the control piston 2 and hence the injection needle are moved.

The control chamber preferably has a cylindrical shape, which merges at the top into a conical shape and which thus tapers toward the centrally arranged drain hole 5. The conical shape represents the first sealing seat 25. The first closing member 10 is preferably in the form of a partial sphere, the diameter of the partially spherical shape being somewhat smaller than the diameter of the cylindrical shape of the control chamber 1. The flat cut surface on the underside of the first closing member 10 is arranged parallel to the flat end face of the control piston 1 and faces the end face of the control piston 1. The length of the control chamber 1 is preferably such that, with the first closing member 10 fully open, i.e. given maximum deflection of the first closing member 10, the closing member 10 just fails to strike the control piston 2, hence ensuring that the control volume is kept as small as possible. The relationship can be precisely defined since the cut surface of the first closing member and the end face of the control piston are flat and arranged parallel to one another.

The control valve shown in FIG. 1 operates as follows: in the rest position, the first closing member 10 is pressed against the first sealing seat 25 by the compression spring 14, and the drain hole 5 is thus closed. This means that the control chamber 1 is connected to the fuel feed 3 only via the feed restrictor 4. In this state, the fuel pressure in the control chamber 1 is equal to that in the fuel feed 3. As a result, the control piston 2 is subjected to the high fuel pressure of the fuel feed 3 and is pushed downwards with a corresponding force. The control piston 2 in turn presses an injection needle onto an associated sealing seat, with the result that no fuel is injected.

If, in the working position, the actuator piston 12 is now moved toward the drain hole 5 by the associated actuator, the first closing member 10 is raised counter to the preloading force of the compression spring 14 and its pressure surface is lifted off from the first sealing seat 25 counter to the pressure in the control chamber 1. In the working position, the control chamber 1 is consequently connected via the drain hole 5 to the drain line which leads to the fuel tank.

In the working position, fuel flows out of the control chamber 1 via the drain hole 5. This lowers the pressure in the control chamber 1, and the control piston 2 is pushed downwards with a correspondingly lower force. Since fuel under high pressure is bearing on the injection needle, the injection needle pushes the relieved control piston 2 in the direction of the drain restrictor 5. At the same time, the injection needle rises from the associated sealing seat and fuel is injected.

To end the injection process, the actuator piston 12 is moved back upwards into the rest position by the associated actuator, and the first closing member 10 is thus pressed against the first sealing seat 25 essentially by the compression spring 14. At this point in time, the pressure in the control chamber 1 is too low to make any significant contribution to closing the drain restrictor 5. As a result, the drain hole 5 is closed and, after a certain time, the fuel pressure prevailing in the fuel feed 3 is re-established in the control chamber 1 since fuel flows into the control chamber 1 via the feed restrictor 4. The control piston is moved back downwards by the high pressure that establishes itself and the injection needle is thus pressed back onto the associated sealing seat, thereby interrupting fuel injection.

With the drain hole 5 open, the fuel pressure falls because more fuel flows out via the drain hole 5 than flows in via the feed restrictor 4. The drain hole 5 is dimensioned accordingly and preferably forms a drain restrictor.

The arrangement shown in FIG. 1 has the advantage that the control volume in the control chamber 1 is small and hence that the drain hole 5 can be opened and closed more rapidly since only the first closing member 10 is arranged in the control chamber 1. The term "control volume" refers to the volume of the control chamber 1 that can be filled with fuel. The larger the control volume, the slower the speed at which the drain hole 5 can be opened or closed. The compression spring 14, which should be relatively large owing to the requirement for a large preload, is preferably situated outside the control chamber 1 and hence has no effect on the control volume of the control chamber 1. It is advantageous if the first closing member is of essentially spherical design. This has the advantage that owing to the spherical shape, the spherical closing member adjusts itself automatically to a conical first sealing seat as it closes the first sealing seat 25.

The first closing member 10 can also preferably be of conical design in the sealing area, the conical shape of the first closing member 10 being associated symmetrically with the conical shape of the first sealing seat 25. In this embodiment, however, the first closing member 25 should be guided centrally and symmetrically with respect to the first sealing seat 25 to ensure that the first sealing seat 25 is closed precisely.

It is particularly advantageous to dimension the drain hole 5 or the drain passage 30 as a drain restrictor, thereby eliminating the need for an additional drain restrictor, and for the drain restrictor to directly adjoin the control chamber, thereby achieving a small control volume.

An outlet recess 37 is preferably provided on the underside of the bottom plate 16 to allow fuel to flow out of the drain hole 5 to the drain even when the bottom plate 16 is in contact, since the bottom plate 16 rests on the valve plate 6 in the working position. Owing to the sleeve shape of the spring plate 13, the actuator piston 12 rests directly on the valve rod 11, the valve rod 11 being made as short as possible, although a relatively large compression spring 14 can nevertheless be used. This ensures a large contact force in the rest position to provide reliable sealing of the first sealing seat 25.

An advantageous embodiment consists in providing a pre-assembled and preset control-valve unit which has the restrictor plate 6 with the drain hole 5 and the first sealing seat 25, the first closing member 10 with the valve rod 11, which is passed through the drain hole 5, the spring plate 13, to which the valve rod 11 is connected, and the spring element 14, which is inserted under preload between the spring plate 13 and the restrictor plate 6. The restrictor plate 6 preferably has the first recess 7, which forms at least part of the control chamber 1. In one embodiment example, it is furthermore also possible for a second recess 8 to be machined into the restrictor plate 6 to accommodate the spring plate 13.

The control-valve unit has the advantage that the individual components have been preassembled and that the maximum stroke of the first closing member 10 has been set. For this purpose, the spring plate 13 is pressed against the restrictor plate 6 from one side, counter to the spring force of the spring element 14, and the first closing member 10 together with the valve rod 11 is pushed through the drain hole 5 into the hole 27 in the bottom plate 16 from the other side. At a given distance between the bottom plate 16 and the first closing member 10, the valve rod 11 is welded firmly to the bottom plate 16. This is preferably accomplished by laser welding. In this operation, the laser beam enters via the open U-shape of the spring plate 13 and welds the valve rod 11 to the bottom plate 16 on the upper side of the bottom plate 16 by means of a weld 17. In this way, a defined maximum stroke for the deflection of the first closing member 10 is preset. Upon assembly of the injection valve, the complete, fully assembled control-valve unit is placed in the housing 36. The control-valve unit is connected firmly to the housing 36, preferably via the restrictor plate 6 by means of appropriate clamping means, such as a union nut.

Figure 2:
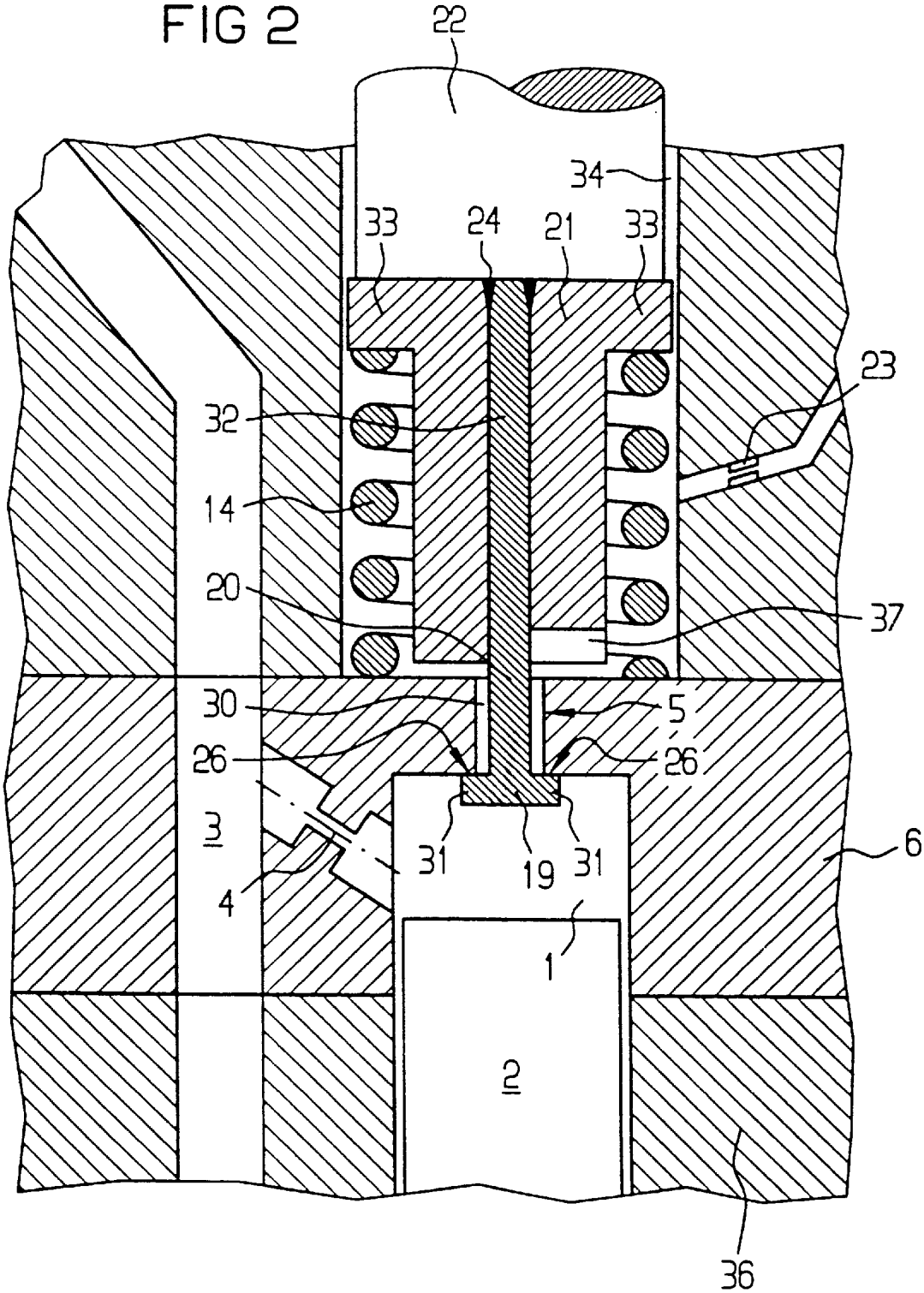
FIG. 2 is a sectional view of a second embodiment of the novel control valve.

Referring now to FIG. 2, there is shown a diagrammatic injection valve with a second embodiment of the control valve. The essential differences relative to FIG. 1 are found in the shape of the closing member, the shape of the spring plate and a drain restrictor 23.

In the control chamber 1, a second closing member 19 is associated with a second sealing seat 26. The second sealing seat 26 and the associated second sealing surface 31 of the second closing member 19 are plane-parallel surfaces which are associated with one another. The second closing member 19 has essentially the shape of a T-piece which merges into a second rod 20 that is passed through the drain hole 5 and through a second hole 32 in a second spring plate 21 and extends as far as the upper side of the second spring plate 21.

At the upper side of the second spring plate 21, the second rod 20 is connected to the second spring plate 21 by means of a second welded joint 24. The second spring plate is of essentially cylindrical design and, in the upper end region, has a second stop ring 33. A compression spring 14 is clamped between the second stop ring 33 and the valve plate 6. The compression spring 14 preloads the second closing member 19 upwards against the second sealing seat 26.

A second actuator piston 22 rests on the upper side of the second spring plate 21. The second actuator piston 22 and the second spring plate 21 are guided in a guide hole 34 in the injection valve.

Branching off from the guide hole 34 in the region of the compression spring 14 is a drain line which passes via a drain restrictor 23 to the fuel tank. In the second spring plate 21, in the region of the bottom, there is furthermore a drain passage 37 which extends from the region of the mouth of the drain hole 5 to the edge zone in which the compression spring 14 is arranged. In place of the drain restrictor 23, it is also possible for the drain hole 5 or the drain passage 30 to be designed as a drain restrictor.

The system shown in FIG. 2 operates as follows: in the rest position, the second sealing surface 31 of the second closing member 19 is pressed against the second sealing seat 26 by the compression spring 14, and the drain hole 5 is thus closed. In the rest position, the fuel pressure prevailing in the control chamber 1 is hence equal to that in the fuel feed 3. Consequently, the control piston 2 is subjected to a correspondingly high pressure.

If the second actuator piston 22 is now moved downwards toward the drain hole 5 by the associated actuator, the second closing member 19 exposes the drain passage 30 formed by the remaining space not filled by the second rod 20 in the drain hole 5. As a result, fuel flows out of the control chamber 1, via the drain passage 30, the drain line and the drain restrictor 23, back to the fuel tank. Since the feed restrictor 4 has a smaller cross section than the drain restrictor 23, the fuel pressure in the control chamber 1 falls. In this embodiment, the drain passage 30 is designed with a flow cross section such that the restricting function is performed by the drain restrictor 23. Consequently, the force acting on the control piston 2 is reduced.

If the second actuator piston 22 is now moved back upwards into the rest position by the associated actuator, the second closing member 19 is pressed back onto the second sealing seat 26 by the compression spring 14, and the drain hole 5 is thus closed. As a consequence, the fuel pressure in the control chamber 1 increases again to the high fuel pressure prevailing in the fuel feed 3. The control piston 2 is thus once more subjected to the original high pressure.

In a development of the invention, however, the drain restrictor 23 may be omitted and the function of the drain restrictor 23 is achieved by appropriate dimensioning of the drain passage 30.

In the embodiment example in FIG. 2, it is also advantageously possible to use a control-valve unit comprising the restrictor plate 6 with the second closing member 19, which is preloaded by means of the second spring plate 21 and a spring means 14 and set to a defined maximum stroke by defining the distance between the second closing member 19 and the second spring plate 21.

The invention has been described using a control chamber with a feed and a drain restrictor as an example, but the invention could be applied to any kind of valve. Moreover, its application is not limited to an injection valve. On the contrary, it can be used in all technical fields.

We claim:

1. An injection valve, comprising:

a housing formed with a control chamber;

a control piston bounding said control chamber and being displaceably disposed in said housing;

a feed conduit communicating with said control chamber for supplying said control chamber with a pressure medium;

a drain communicating with said control chamber for draining pressure medium out of said control chamber, said drain being formed with a sealing seat on a high-pressure side;

a closing member disposed in said control chamber on the high-pressure side and being operatively associated with said sealing seat of said drain for selectively opening and closing said drain;

a control device outside said control chamber and operatively connected with said closing member;

a valve rod connected to said closing member, passing through said drain, and being operatively connected with said control device;

a spring holder connected to said valve rod on the low-pressure side, said spring holder being formed as a sleeve with a hollow space and a bottom plate at one end thereof, said bottom plate being connected to said valve rod and being associated with said drain;

a spring member clamped outside said control chamber between said spring holder and said housing for preloading said closing member against said sealing seat;

an actuator piston operatively connected with said control device and inserted into said hollow space of said sleeve; and a plate formed with an opening defining said drain, formed with a second recess adapted to partially accommodate said spring holder, and formed with a first recess at least partially forming said control chamber and defining said sealing seat.

2. The injection valve according to claim 1, wherein said bottom plate is formed with an opening, said valve rod passes into said opening, and said valve rod is connected to said bottom plate in an upper region of said bottom plate.

3. The injection valve according to claim 1, wherein said drain is formed as a flow restrictor.

4. The injection valve according to claim 1, wherein a shape of said closing member is matched to a shape of said control chamber for minimizing a control volume of said control chamber.

5. The injection valve according to claim 1, which comprises a control-valve unit including:

said plate formed with said opening defining said drain;

said closing member and said valve rod extending through said drain;

said spring holder with said valve rod connected thereto;

said spring element clamped between said spring holder and said plate and preloading said closing member against said sealing seat, wherein a spacing distance between said closing member and said spring holder is fixed at a predetermined value for setting a maximum stroke of said closing member.

* * * * *